US009637946B2

(12) United States Patent
Warner et al.

(10) Patent No.: US 9,637,946 B2
(45) **Date of Patent: *May 2, 2017**

(54) AIR BEAM SYSTEM FOR AN AIR BEAM STRUCTURE

(71) Applicant: DYNAMIC SHELTERS INC., Calgary (CA)

(72) Inventors: Harold Warner, Calgary (CA); David Ritzel, Amherstburg (CA)

(73) Assignee: Dynamic Shelters Inc., Calgary, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/082,855

(22) Filed: Mar. 28, 2016

(65) Prior Publication Data

US 2016/0282089 A1 Sep. 29, 2016

Related U.S. Application Data

(63) Continuation of application No. 14/534,055, filed on Nov. 5, 2014, now Pat. No. 9,395,160, which is a (Continued)

(51) Int. Cl.
*E04H 15/20* (2006.01)
*F42D 5/05* (2006.01)

(Continued)

(52) U.S. Cl.
CPC ..... *E04H 15/20* (2013.01); *E04H 9/04* (2013.01); *E04H 9/14* (2013.01); *F41H 5/06* (2013.01);

(Continued)

(58) Field of Classification Search
CPC ..... E04H 9/04; E04H 15/20; E04H 2015/201; E04H 2015/203; E04H 2015/204

(Continued)

(56) References Cited

U.S. PATENT DOCUMENTS 2,837,101 A * 6/1958 Bary ..... E04H 15/20 47/29.1
2,955,606 A * 10/1960 Walker ..... E04H 15/20 135/121

(Continued)

FOREIGN PATENT DOCUMENTS

CA 2927192 A1 * 6/2016
JP 02308050 A * 12/1990

(Continued)

*Primary Examiner* — Robert Canfield
(74) *Attorney, Agent, or Firm* — Gowling WLG (Canada) LLP

(57) ABSTRACT

A tethermast and frag wall includes a fabric device having a fill volume fillable with a fill material on a flexible or compliant mast system. The fill volume may be a chambered curtain. The tethermast and frag wall is self supporting, easily deployed, and may be used in connection with a structure or may be deployed stand-alone. A tether system for an air beam structure utilizing a flexible tethermast, an external frag wall or frag curtain, soft couplings, air beam slings, or combinations thereof to reduce the effects of pressure waves, such as blast waves, onto and into an air beam structure and any inhabitants.

10 Claims, 29 Drawing Sheets

Related U.S. Application Data continuation of application No. 13/516,069, filed as application No. PCT/CA2010/001951 on Dec. 14, 2010, now Pat. No. 9,267,765.

(60) Provisional application No. 61/286,194, filed on Dec. 14, 2009.

(51) Int. Cl.

| | |
|---|---|
| ***F41H 5/06*** | (2006.01) |
| ***F41H 5/24*** | (2006.01) |
| ***E04H 9/04*** | (2006.01) |
| ***E04H 9/14*** | (2006.01) |

(52) U.S. Cl.
CPC ..... *F41H 5/24* (2013.01); *F42D 5/05* (2013.01); *E04H 2015/201* (2013.01); *E04H 2015/203* (2013.01); *E04H 2015/204* (2013.01); *Y10T 24/39* (2015.01)

(58) Field of Classification Search
USPC ..... 52/2.11, 2.13, 2.21, 2.25, 2.26
See application file for complete search history.

(56) References Cited

U.S. PATENT DOCUMENTS

| | | | | | |
|---|---|---|---|---|---|
| 4,068,674 | A * | 1/1978 | Mitchell | E04H 15/20 | 135/117 |
| 4,631,873 | A * | 12/1986 | Parish | E04H 15/20 | 135/125 |
| 5,333,970 | A | 8/1994 | Heselden | | |
| 5,555,679 | A * | 9/1996 | Scherba | E04H 15/20 | 135/126 |
| 7,716,876 | B2 * | 5/2010 | Wiegand | E04H 15/20 | 52/2.11 |
| 7,789,592 | B2 | 9/2010 | Heselden | | |
| 8,991,104 | B2 * | 3/2015 | Warner | E04C 3/005 | 52/2.11 |
| 9,395,160 | B2 * | 7/2016 | Warner | F42D 5/05 | |
| 2007/0271854 | A1 * | 11/2007 | Wiegand | E04H 15/20 | 52/2.11 |
| 2010/0064627 | A1 | 3/2010 | Heselden | | |
| 2010/0139175 | A1 * | 6/2010 | Warner | E04C 3/005 | 52/2.11 |
| 2010/0146868 | A1 * | 6/2010 | Lukasiewicz | E04H 15/18 | 52/2.11 |
| 2012/0247311 | A1 * | 10/2012 | Warner | F42D 5/05 | 89/36.01 |

FOREIGN PATENT DOCUMENTS

| | | | | |
|---|---|---|---|---|
| JP | 04339966 | A * | 11/1992 | |
| WO | WO 8903468 | A1 * | 4/1989 | E04H 15/20 |
| WO | 9012160 | | 10/1990 | |
| WO | 2008037972 | | 4/2008 | |

* cited by examiner

AIR BEAM SYSTEM FOR AN AIR BEAM STRUCTURE

CROSS REFERENCE TO RELATED APPLICATIONS

This application is a continuation of the U.S. patent application Ser. No. 14/534,055 filed on Nov. 5, 2014, which is a continuation/divisional of the parent application Ser. No. 13/516,069 filed on Jun. 14, 2012 (now issued as U.S. Pat. No. 9,267,765), which is a national stage entry of PCT/CA2010/001951 filed on Dec. 14, 2010, which claims the benefit of priority from U.S. provisional patent application No. 61/286,194 filed on Dec. 14, 2009, which is incorporated herein by reference in its entirety. The entire disclosures of the above applications are incorporated herein by reference.

FIELD OF THE INVENTION

The present invention relates generally to pressure or projectile protection for a structure and inhabitants. More particularly, the present invention relates to methods and apparatus for restraining and protecting an airbeam structure and human inhabitants from pressure waves, flying debris, artillery and mortar fragmentation, and small arms fire.

BACKGROUND OF THE INVENTION

Air beam structures must be tethered to a support surface or the ground in order to fix them in place. Current tether systems and the air beam structures are vulnerable to pressure waves, such as hurricane force winds or explosion/blast pressure waves, as well as flying debris and small arms fire and other projectiles.

Frag walls protect personnel and equipment from projectiles such as small arms fire, and flying projectiles.

WO/1990/12160 by Heselden, titled Improvements Relating to Building and Shoring Blocks, is described in the abstract (with reference numerals removed) as the invention provides that wire mesh cage structures are used to provide structural blocks usable in building, shoring, walls and the like. The cage is lined with a geotextile fibrous material which allows the passage therethrough of water, but not particulate material such as cement, sand aggregate which are used as materials for filling the cage. The invention discloses novel forms of cage structure and also that the finished blocks can be coated with curable synthetic resin to conceal the mesh and provide a decorative surface finish.

U.S. Pat. No. 5,333,970 (Heselden), U.S. Pat. No. 7,789,592 (Heselden), and US 20100064627 (Heselden) may also form background of the invention.

A commercial product available from HESCO is depicted at http://www.hesco.com/prod_con.html http://www.army-technology.com/contractors/infrastructure/hesco/

The HESCO product relies on wire mesh with fabric to stop fill from pouring out between mesh, and provides ballistic resistance with a mass of fill which can result in an increased logistic fill cost in resources, time, and money, and cannot be practically relocated.

WO/2008/037972 by Milton et al. titled Cellular Confinement Systems, is described in the abstract (with reference numerals removed) as a cellular confinement system for soil, sand or other filler material comprises a number of sub-assemblies each made up of a plurality of interconnected open cells of fabric material. The sub-assemblies are stackable one on top of the other to provide a structure having at least one generally vertical side or end wall. The system further comprises sealing means such as one or more skirt portion(s) which are arranged between vertically juxtaposed sub-assemblies in use. The skirt portions substantially prevent or minimise the escape of finer aggregate material from between the stacked sub-assemblies.

A commercial product DefenCell™ is depicted at:

http://www.defencell.com/

It is desirable to provide a new tether system, and frag wall, which better secures and protects air beam structures.

SUMMARY OF THE INVENTION

It is an object of the present invention to obviate or mitigate at least one disadvantage of previous tether systems and frag walls.

The tethermast and frag wall includes a fabric device having a fill volume filled with a fill material on a flexible or compliant mast system. The fill volume may be a chambered curtain. The tethermast and frag wall is self supporting, easily deployed, and may be used in connection with a structure or may be deployed stand-alone.

In a first aspect, the present invention provides a tether system for an air beam structure having flexible tethermast adapted to secure to a support surface, and a plurality of tethers extending between the tethermast and the air beam structure.

In a further embodiment, there is provided a frag wall having a hollow fillable container having a hinged divider, expandable between a collapsed state and an expanded state, the frag curtain adapted to receive a frag fill material in the expanded state.

In further aspect, the present invention provides a frag curtain having a support member extending along a length of the structure, and a flexible curtain member suspended from the support member.

In further aspect, the present invention provides a soft coupling for a tether system having an inner attachment flap adapted for attachment to an inner side of a planar surface, an outer attachment flap adapted for attachment to an outer side of the planar surface, the inner attachment flap and the outer attachment flap aligned and attached through the planar surface.

In a further aspect, the present invention provides a free-standing frag wall adapted to be filled with a fill material in order to provide a wall structure providing ballistic resistance, the frag wall having a partitioned internal void, and a reinforced rear panel.

In a further aspect, the present invention provides a self-supporting cellular frag wall adapted to be filled with a fill material, the frag wall comprising a hollow wall section having a plurality of fill cells formed by partitions extending through the hollow wall section, the partitions adapted to support the frag wall prior to filling.

In an embodiment of the invention, the frag wall further includes a reinforced rear panel. In an embodiment of the invention, the reinforced rear panel includes an aramid material.

In a further aspect, the present invention provides a self-supporting cellular frag wall having a plurality of pressure retaining compartments formed by partitions extending through the frag wall, the pressure retaining compartments adapted to be filled with a fill material, the pressure retaining compartments adapted to at least partially contain a pressure wave created in the fill material when the frag wall is struck by a projectile.

In an embodiment of the invention, the frag wall further includes a reinforced back panel.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and system for tethering a structure; such as an air beam structure and for providing a physical protective barrier to protect the structure from pressure waves or projectiles or both.

Figure 1:
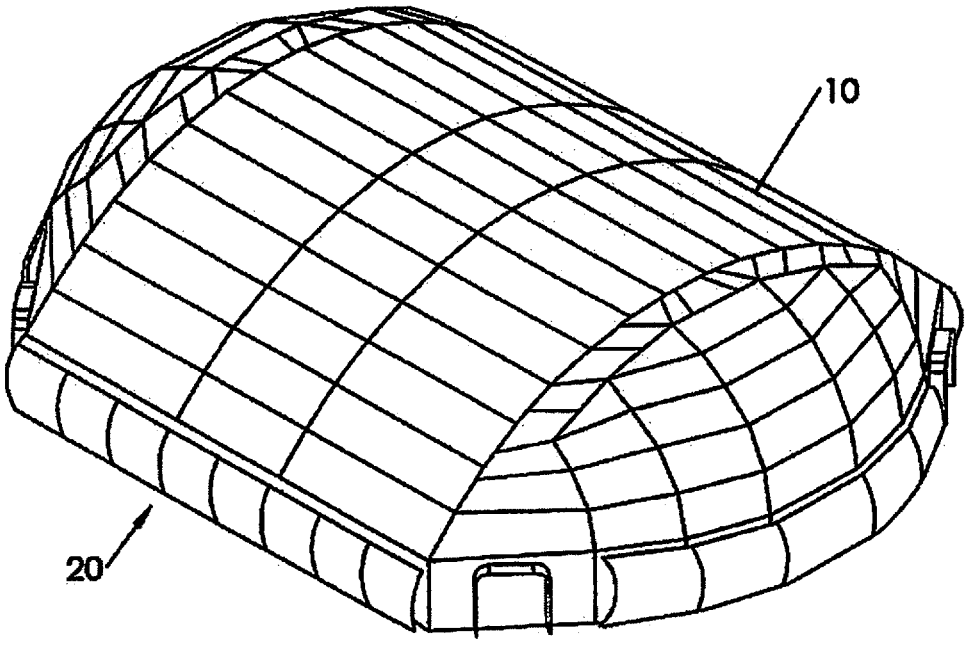
FIG. 1 is an air beam structure including aspects of the present invention.

Referring to FIG. 1 a structure (10) includes a frag curtain or frag wall (20) surrounding at least a portion or portions of the structure to protect the structure from projectiles or pressure waves or both. The frag curtain or frag wall may also serve as a thermal barrier to shield the structure from the heat or fireball from a blast or other explosion or fire.

Figure 2:
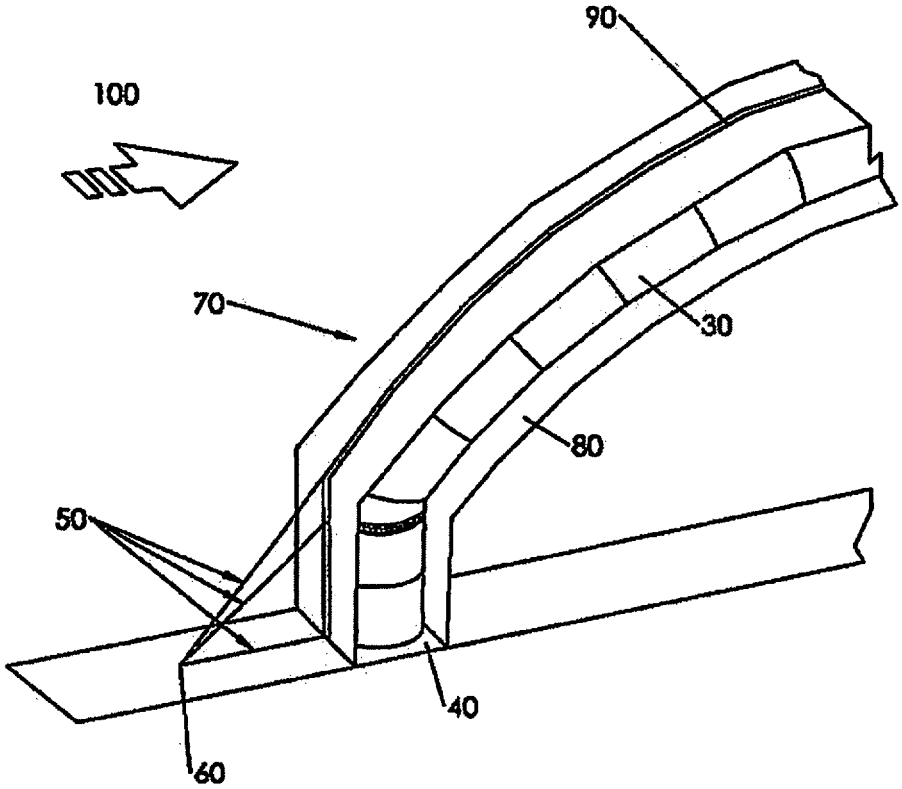
FIG. 2 is a tether system of the present invention.

Referring to FIG. 2, an air beam (30) may be attached to the support surface (40) (ground, floor, slab, footing or other support surface) by a plurality of tethers (50) extending between an anchor (60) and the air beam (30). As there may be gaps between adjacent air beam arches, an external fly (70) may extend across the surface formed across the air beam arches to provide external closure. Similarly, an internal liner (80) may extend across the surface formed across the air beam arches to provide internal closure. Pressure/blast direction (100).

Figure 3:
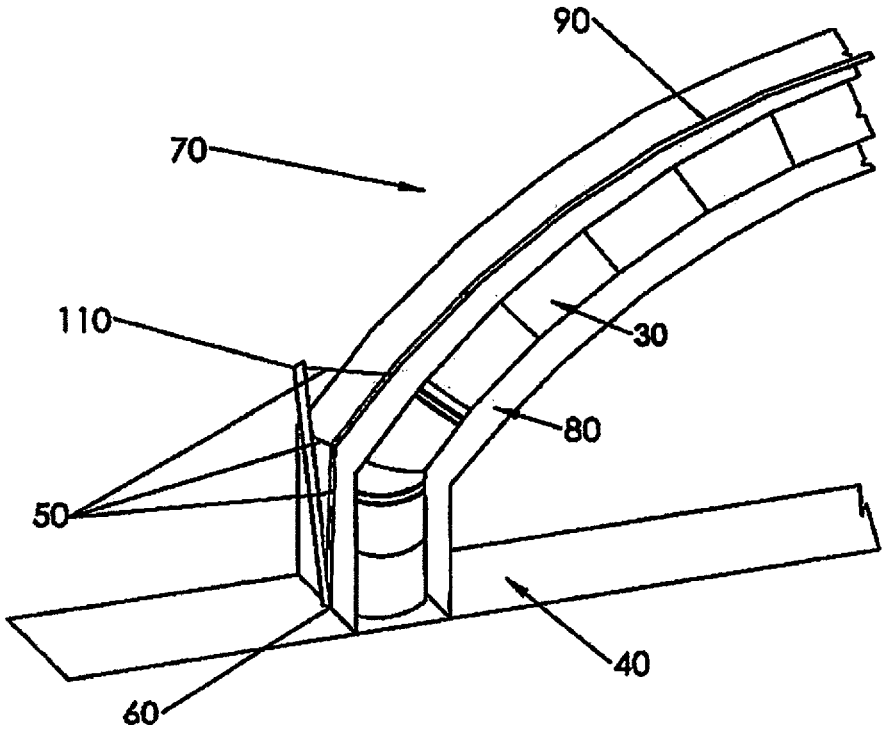
FIG. 3 is a tether system of the present invention.

Referring to FIG. 3, the air beam arch may be attached to the support surface by a plurality of tethers (50) extending between the air beam and a tethermast (110), the tethermast anchored to the ground or weighted. The tethermast is preferably relatively flexible or compliant in order to absorb or dissipate lateral loads exerted on the tethermast (110). Note that the tethermast is depicted aligned with the air beam, but that is but one embodiment. In another embodiment the tethermast(s) may be placed in the gap between adjacent air beams. The tethermast may be flexible in one plane, for example parallel to the expected direction of the blast or pressure wave, or may be flexible in a plurality of planes. The tethermast (110) may be flexible in terms of a compliant member or may include a leaf spring or other spring system or energy dissipating system and may optionally be damped.

Figure 4:
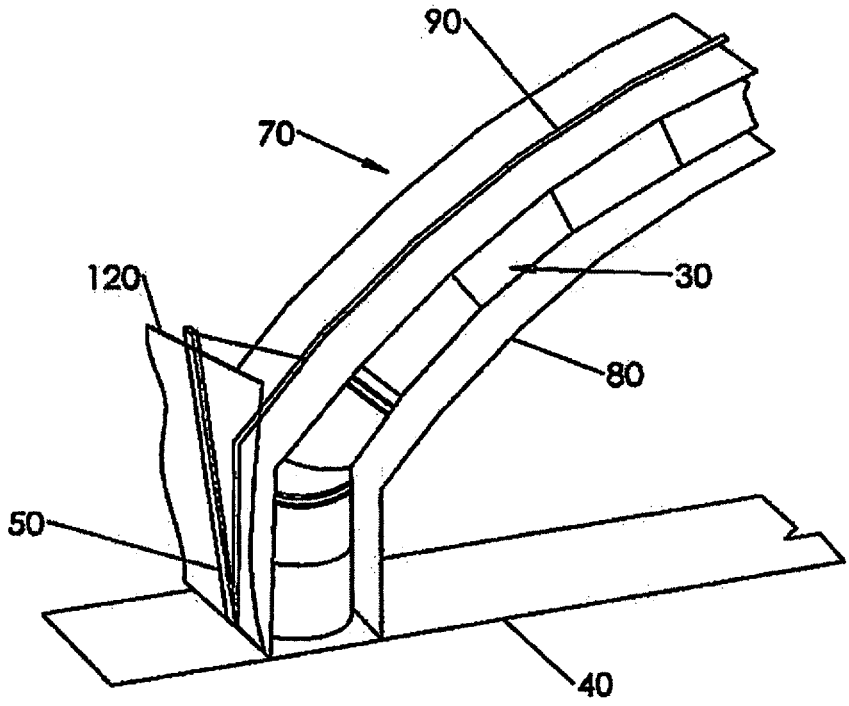
FIG. 4 is a tether system of the present invention.

Referring to FIG. 4, a protective frag curtain or frag wall may be installed external to structure to provide protection from projectiles or pressure waves or both. The frag curtain or frag wall may be supported by a support member (120), extending between two or more tethermasts, such as a rope, cable, or webbing or the frag curtain or frag wall may be self supporting on the support surface (40) or both. The frag curtain or frag wall may be secured to the support surface (40) or may be weighted to be supported in tension by gravity.

Figure 5:
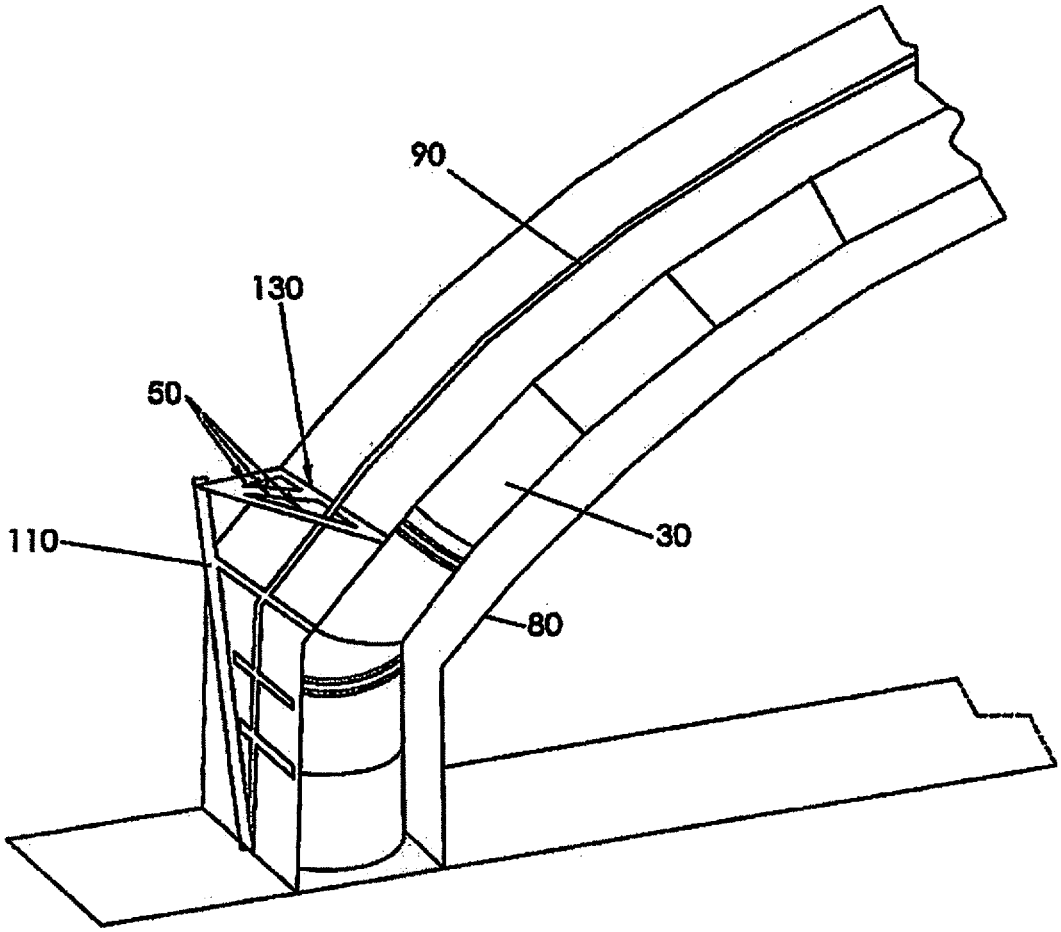
FIG. 5 is a tether system of the present invention.

Referring to FIG. 5, a reinforcing member (130), such as webbing may extend across the external fly for attaching additional tethers (50). As shown in this FIG. 5, a centre tether may connect with the air beam (30) (for example the backbone cable (90) or other device for transferring loads) and additional, side or transverse tethers (50) may connect with the reinforcing member or external fly or both (in a V-shape).

Figure 6:
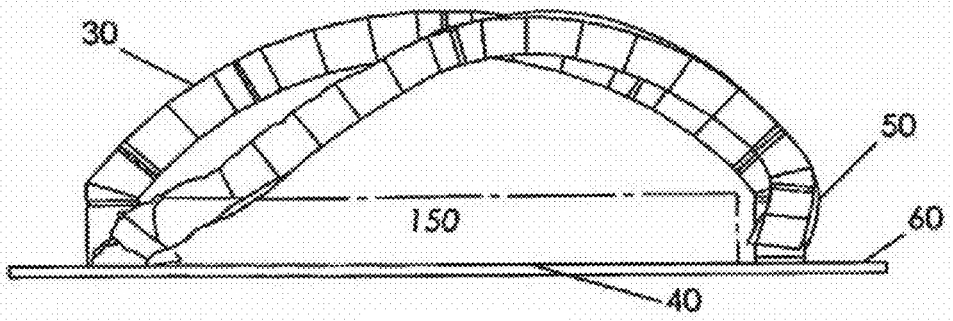
FIG. 6 is a side section view of an air beam structure subject to a blast pressure wave (without tethermast and without frag wall)

Referring to FIG. 6, an air beam structure may have a primary habitable space (150), defined as a portion of the structure, between the support surface (40) and a selected height, such as 5' or 10' or more depending on the usage of the primary habitable space (150). In the event of a pressure wave or pressure spike, for example a blast wave from an explosion, a portion of the air beam structure may be forced into the primary habitable space risking injury to live occupants or damage to property or both. Area Intrusion: 6.1%. In addition, the deflection of the air beam (30) allows a portion of the pressure wave to be transmitted from the exterior of the structure to the interior of the structure, again with the risk of injury to live occupants or damage to property or both.

Figure 7:
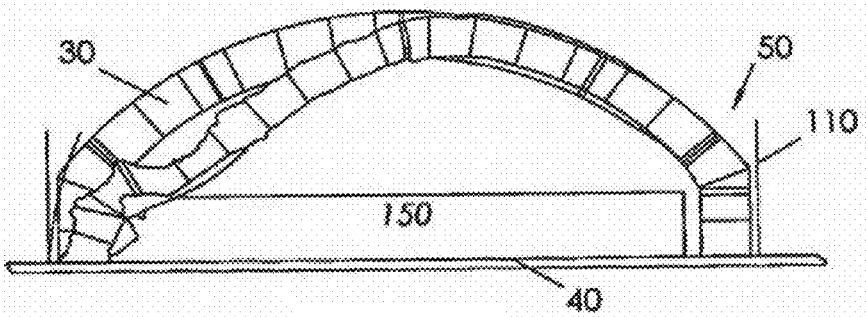
FIG. 7 is a side section view of an air beam structure subject to a blast pressure wave (with tethermast)

Referring to FIG. 7, the tethermast (110) of the present invention reduces the intrusion of the deformed structure into the habitable space (150) and reduces the transmission of the blast wave into the interior of the structure. Area Intrusion: 2.2%.

Figure 8:
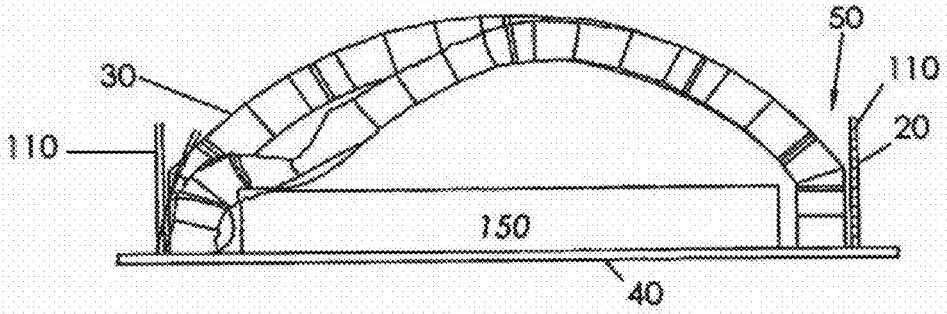
FIG. 8 is a side section view of an air beam structure subject to a blast pressure wave (with tethermast and with frag wall)

Referring to FIG. 8, the frag wall or frag curtain (20) of the present invention reduces the intrusion of the deformed structure into the habitable space and reduces the conveyance of the blast wave into the interior of the structure. Area Intrusion: 0.8%.

Figure 9:
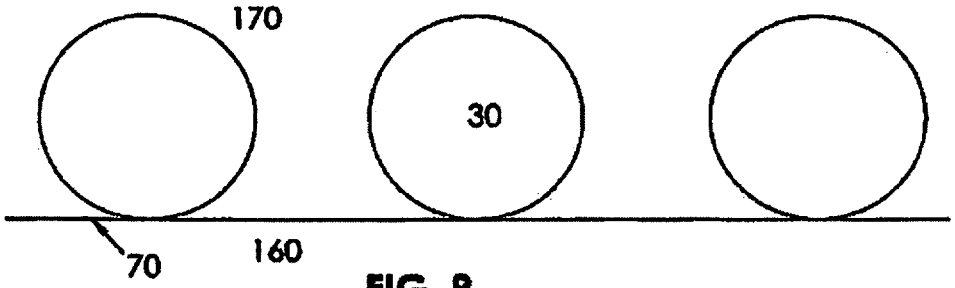
FIG. 9 is a top section view of an air beam structure (at rest)
Figure 10:
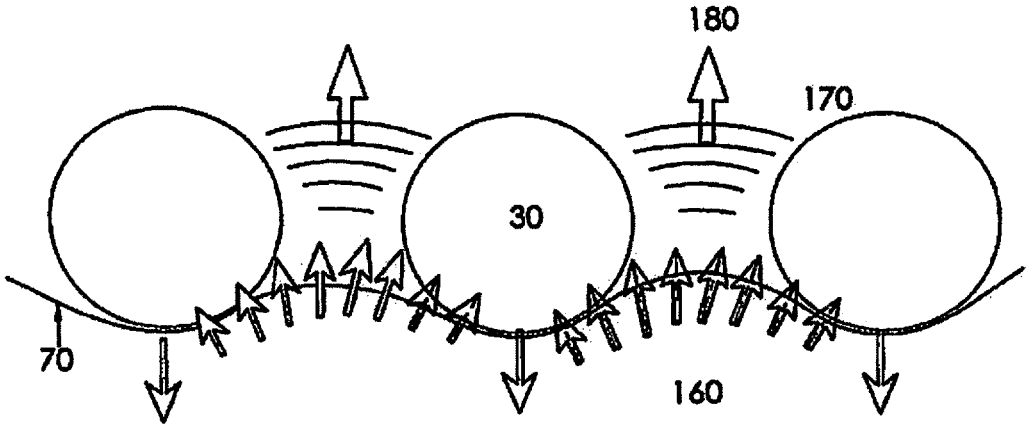
FIG. 10 is a top section view of an air beam structure subject to a blast pressure wave (without tethermast and without frag wall)

Referring to FIGS. 9 and 10, an unsupported external fly (70) is typically used to cover the spaces between adjacent air beam members (see also FIG. 2). In the event of a pressure or blast wave, the ground tethers hold the air beam members in place, but due to deflection the external fly may move from an at rest state (FIG. 9) to a deflected state (FIG. 10) resulting in the transmission of a portion of the blast wave to the interior (170) of the structure. Transmitted Blast (180).

Figure 11:
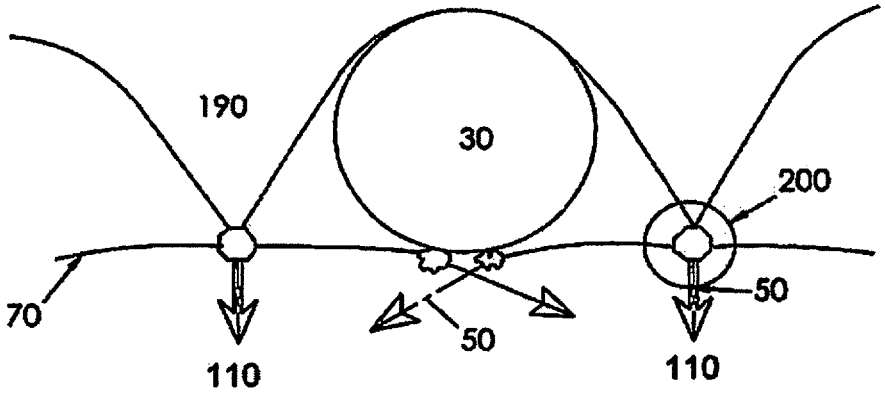
FIG. 11 is a top section view of an air beam structure with a tether system of the present invention.

Referring to FIG. 11, the air beam member and the external fly may be tethered (50) to the tethermast (110). An air beam connection member, such as a rope or cable or webbing etc., may extend around the air beam member, providing a connection or connections, soft coupling (200) through or across the external fly (70) to one or more tethermast (110). An air beam sling (190) may extend around the air beam member (30), providing a soft-connection or soft-connections through or across the external fly (70) to one or more tethermast (110).

Figure 12:
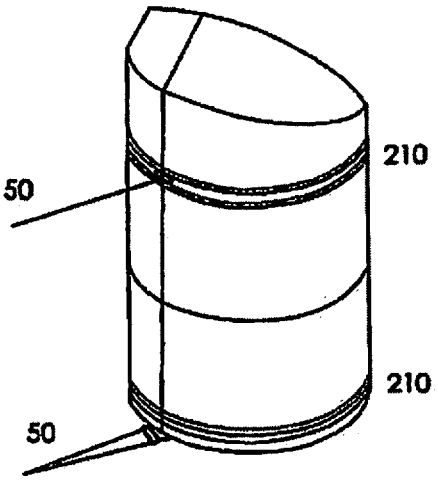
FIG. 12 is a perspective section of an air beam member with hug straps.

Referring to FIG. 12, the air beam connection member may include a hugstrap of the type disclosed in US patent publication number US20100139175. Mid Hug Strap (210). Bottom Hug Strap (210).

Figure 13:
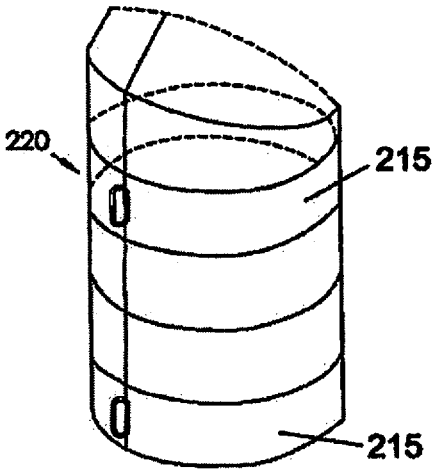
FIG. 13 is a perspective section of an air beam member with wide hug straps.

Referring to FIG. 13, the air beam connection member may include a wide hugstrap which extends around the air beam and which may be free to move relative to the air beam or may be attached to the air beam by stitching, welding, adhesive, Velcro™, or other attachment means to provide a distributed load pickup. In FIG. 3, the wide hugstrap and the air beam are attached at three locations, 90 degrees, 180 degrees, and 270 degrees (relative to the distributed load pickup (220)). This attachment, attach (215), is for holding the wide hugstrap in a selected position only and is not a structural connection.

Figure 14:
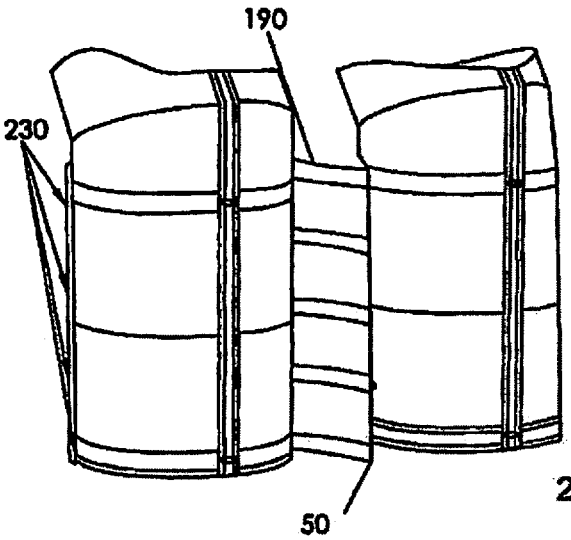
FIG. 14 is a perspective section of an air beam structure with air beam sling.
Figure 15:
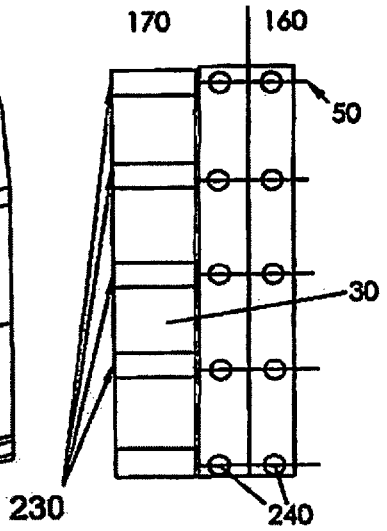
FIG. 15 is a detail of the air beam sling of FIG. 14.

Referring to FIG. 14, the air beam connection member may include an air beam sling (190) (see also above FIG. 11). In this figure, the external fly is shown transparent and in the view shown, we are looking "through" the external fly. The air beam sling (190) may include reinforcing (230) members, such as webbing or other reinforcing means. Tethers (50) extend between the air beam sling and tethermasts.

Referring to FIGS. 15-18, the loads are transmitted through or across the external fly through the use of a soft coupling. A number of attachment flaps (240) (four shown) are positioned in a "+" configuration, and sewn as shown through the fly. A number of grommets or other fastening means are provided to attach tethers on the inside, interior (170), extending to the air beam(s) and attach tethers (50) on the outside, exterior (160), extending to the tethermast(s).

Figure 16:
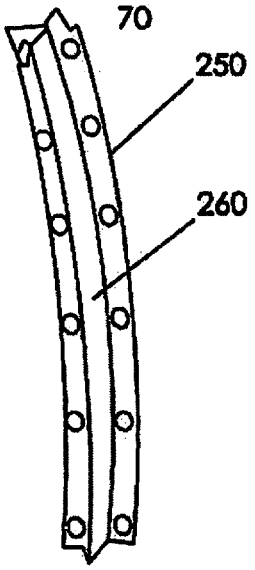
FIG. 16 is a section of a soft coupling of the present invention.

Referring to FIG. 16, nylon webbing (250); several options for attachments to tethers e.g. grommets. These flanges (260) sewn-through to matching flap on the other side; this transfers load independently of strength of fly. If treated with weather seal some holes should not have major seapage problem more than via through holes initially proposed; the internal space behind this tab is inaccessible.

Figure 17:
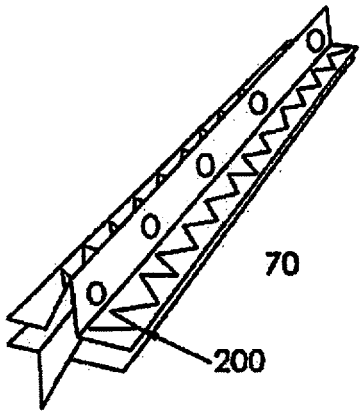
FIG. 17 is further view of the soft coupling of FIG. 16.

Referring to FIG. 17, soft couplers (200) can be made from single folded webbing strip saw-through or rivets.

Figure 18:
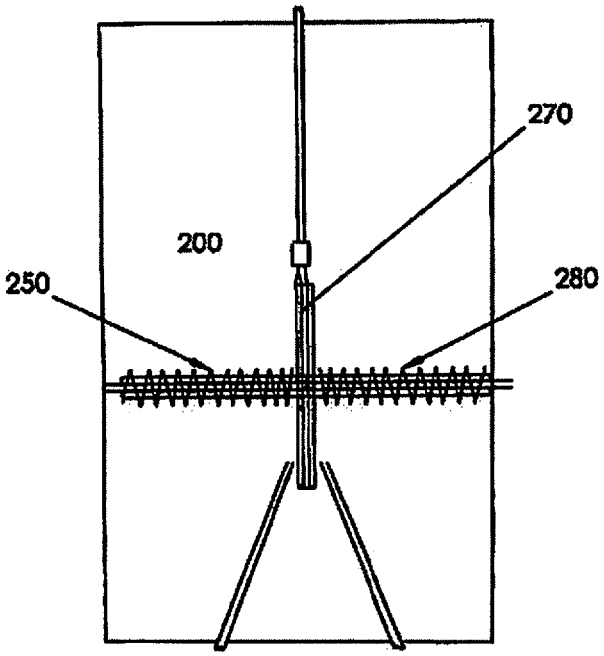
FIG. 18 is a top section view of a soft coupling of the present invention.

Referring to FIG. 18, grommets (270) holes or other options. Nylon webbing (250) reinforcement. Heavily sewn through (280).

Figure 19:
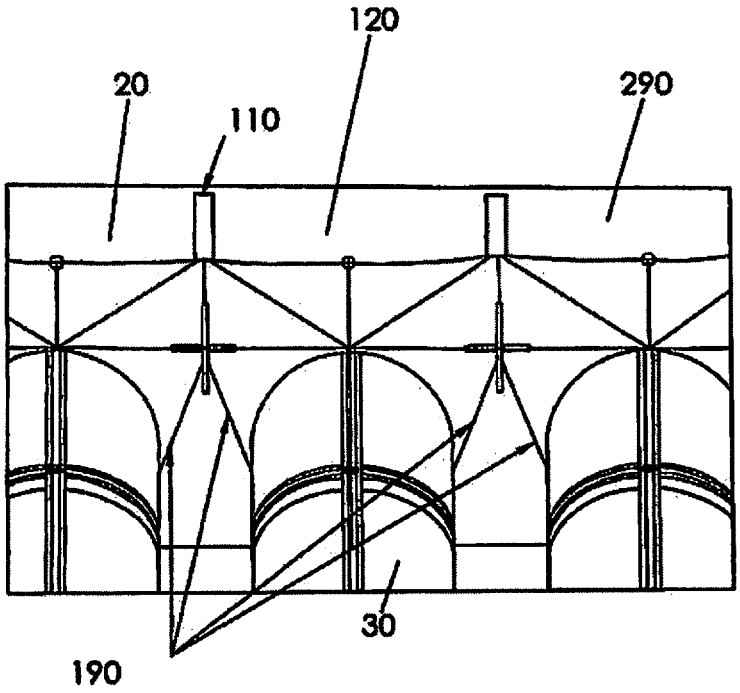
FIG. 19 is a top section view of a tether system of the present invention (with soft coupling, tethermast, and frag wall)

Referring to FIG. 19, a tether system is shown including a number of different tie downs, including tethermasts (110), frag curtain or frag wall (20), cross-ties, soft couplers, hugstraps, and air beam slings (190). Secure to top-cable (120) of tethermast curtain. Tether mast upper beam cross section (290).

Figure 20:
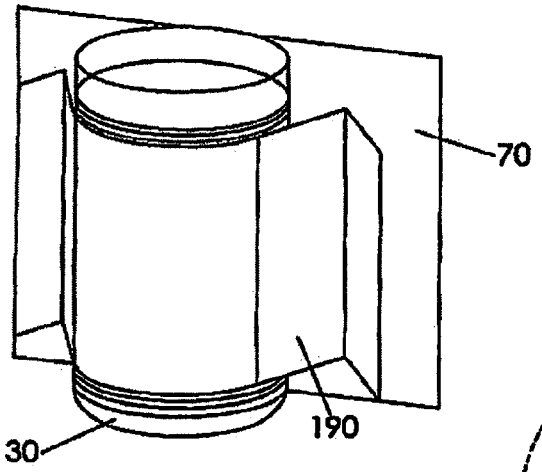
FIG. 20 is a perspective section view of an air beam sling of the present invention.

Referring to FIG. 20, the air beam sling (190) may extend along a significant length of the air beam member (30).

Figure 21:
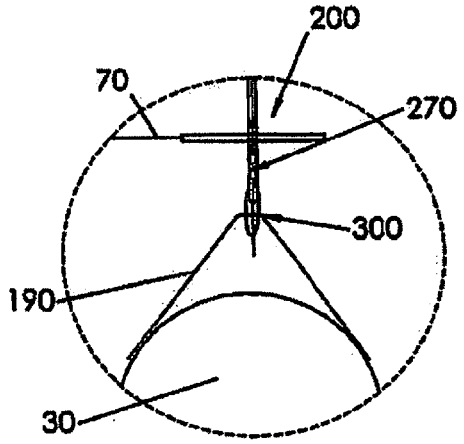
FIG. 21 is a top section view of an air beam sling utilizing a single soft coupling connection.
Figure 22:
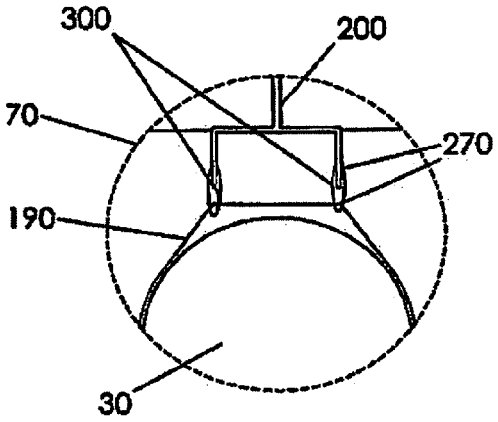
FIG. 22 is a top section view of the air beam of FIG. 20 (at rest)
Figure 23:
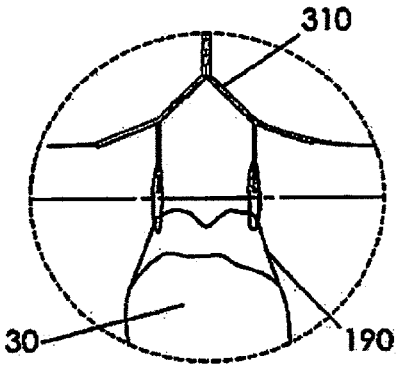
FIG. 23 is a top section view of the air beam of FIG. 20 (in deformation)
Figure 24:
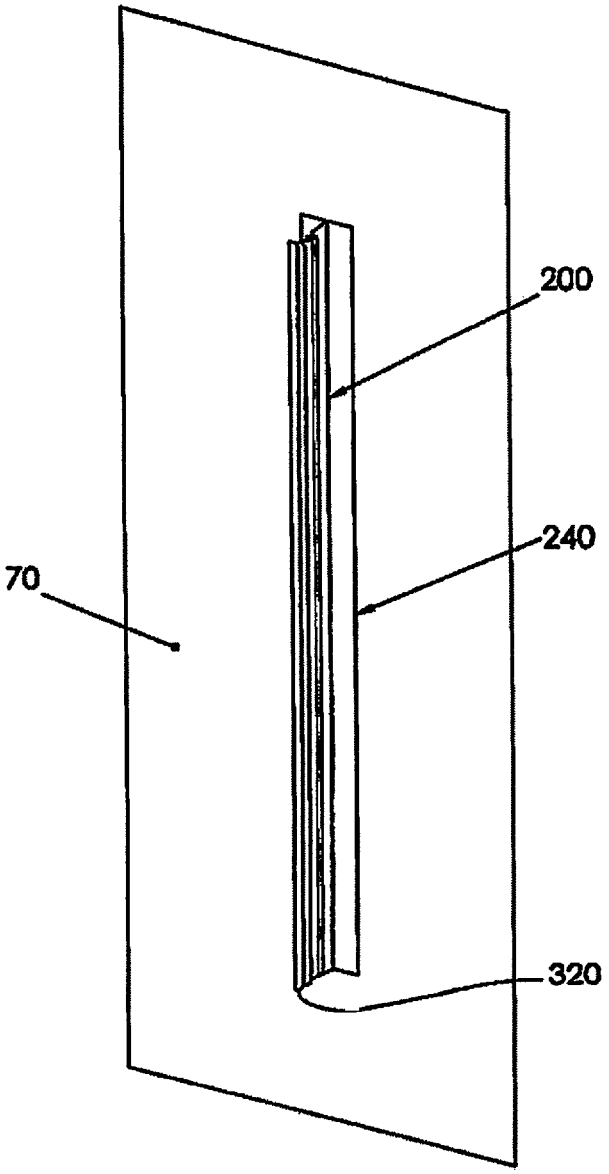
FIG. 24 is a perspective view of a soft coupling of the present invention.
Figure 25:
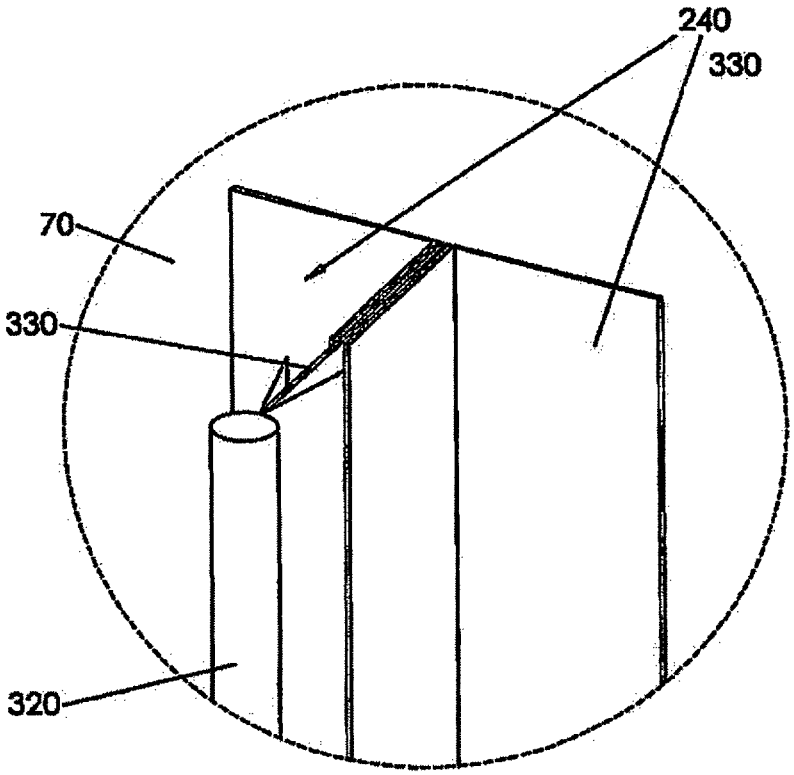
FIG. 25 is a detail perspective view of the soft coupling of FIG. 24.
Figure 26:
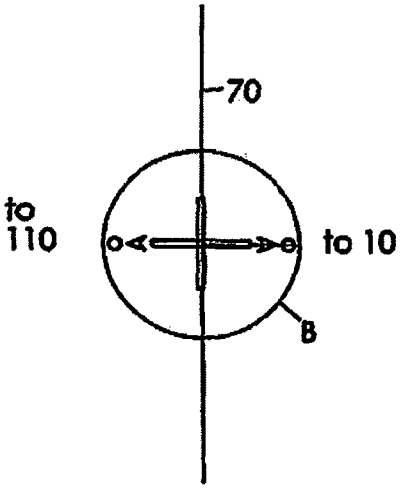
FIG. 26 is a top view of the soft coupling of FIG. 24.
Figure 27:
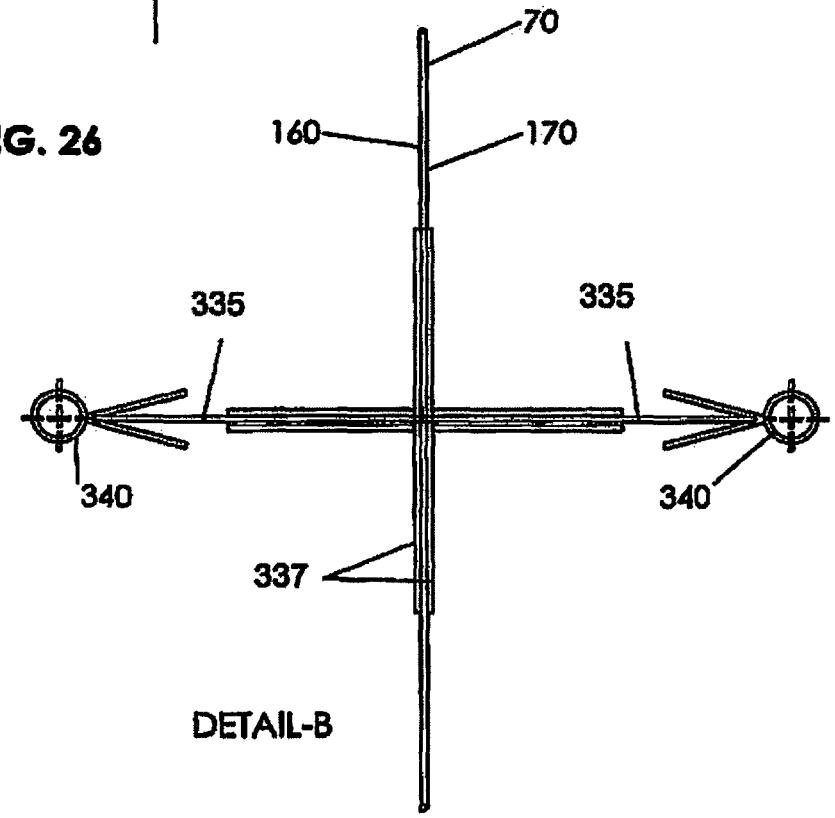
FIG. 27 is a detail view of section B of FIG. 26.

Referring to FIGS. 21-23, the design may include a single soft coupling (200) (FIG. 21) or a plurality of soft couplings (200) (FIG. 22-23). The soft coupling (200) may be aligned with the air beam or may be offset. In a blast/pressure wave, the soft coupling connection will encounter shear stress/strain (310) rather than peel. Air beam sling (190) lace down (300) via grommet (270).

Figure 28:
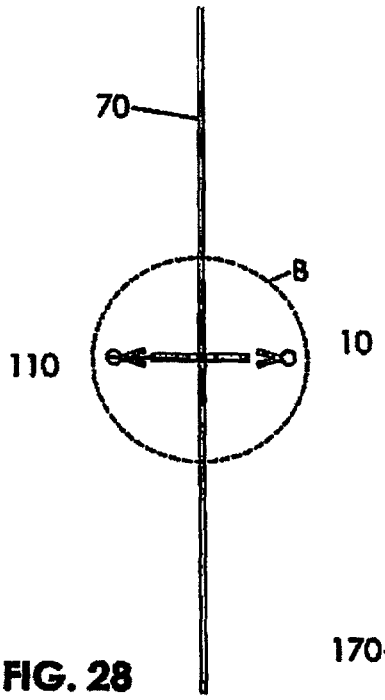
FIG. 28 is a detail view of an alternate design of the soft coupling of FIG. 24 (having no weld reinforcement #2)
Figure 29:
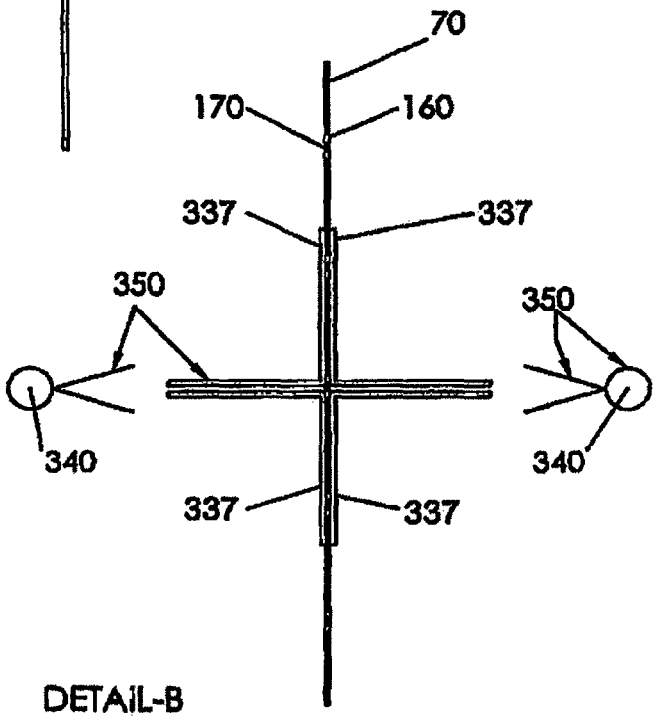
FIG. 29 is a detail view of section B of FIG. 28.

Referring to FIGS. 24-30, the soft coupler, soft coupling (200), may extend along a significant length to correspond to a significant length of the air beam. A plurality of attachment flaps (240) may be arranged to provide reinforcing to the weld. An edge reinforcing member (320) may be attached to the attachment flaps (240). Referring to FIGS. 24-27, a weld reinforcement member, weld reinforcement (330), may be used between the edge reinforcing member (320) and the attachment flaps (240). Weld reinforcement-2 (335). Referring to FIGS. 28-29, the edge reinforcing member (320) and the attachment flaps (240) may be connected directly. Keder (340) RF welded (350) to Weld reinforcement-1 (337).

Figure 30:
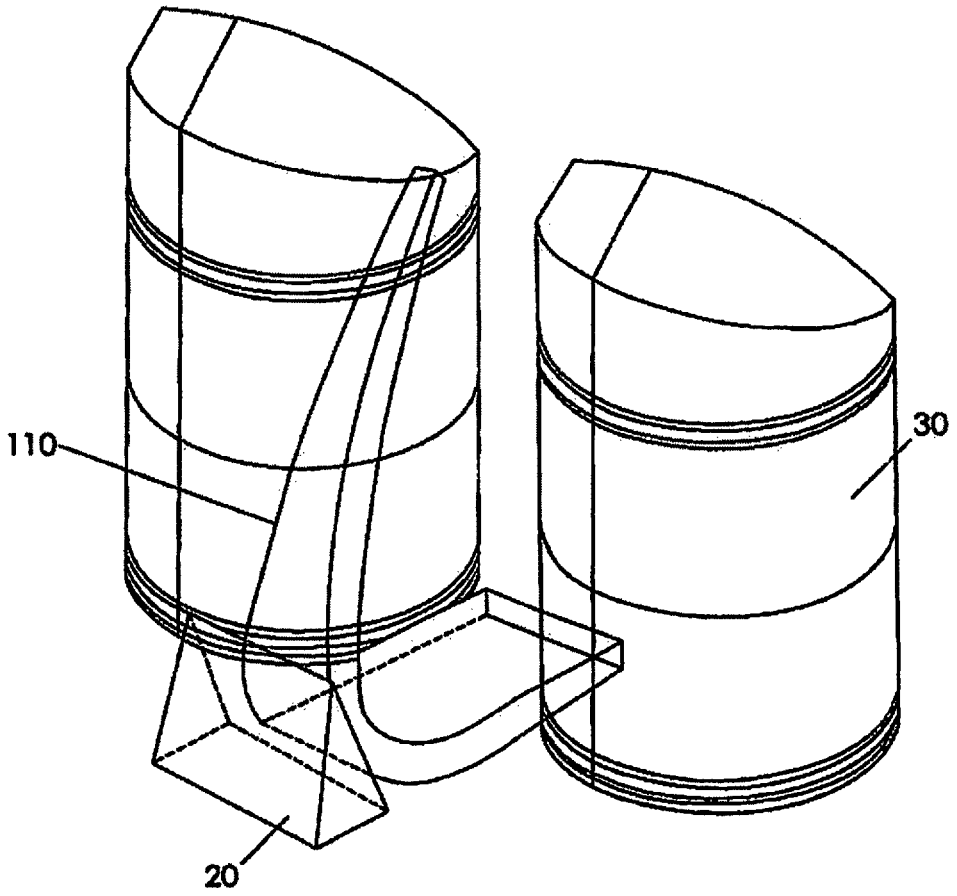
FIG. 30 is a perspective section view of a tether system of the present invention with tethermast and frag wall (with external fly shown transparent)

Referring to FIG. 30, the tethermast (110) may be protected by a frag wall of a selected height, Frag Wall or Frag Curtain (20). As shown, the frag wall may extend up a portion of the tethermast, but in an alternate embodiment, the frag wall may extend up a substantial height, even to the point of exceeding the height of the tethermast. In this figure, the external fly is shown transparent.

Figure 33:
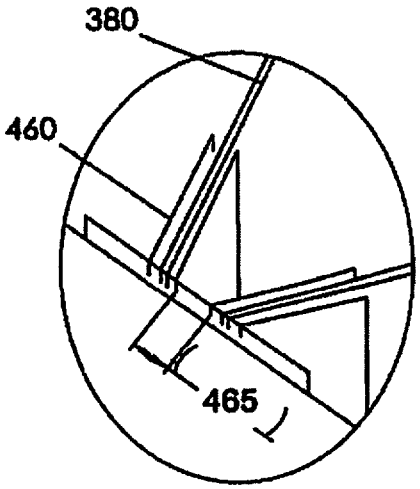
FIG. 33 is a detail view of section B of FIG. 31.

Referring to FIGS. 31-35, the frag wall (370) may include a hollow fillable structure which may be transported in a collapsed state (FIG. 32) and may be expanded to an expanded state (FIG. 31) to provide a frag wall volume fillable with a frag wall fill. A divider (380), 4 mm DASL board Dividers (12 required), breaks the frag wall volume into smaller compartments. The divider (380) may be hinged to allow movement between the collapsed state and the expanded state (FIG. 33). A fabric hinge, welded/glued fabric hinge (460), may be constructed of a flexible material welded or glued to the divider, 40 mm (465), 50 mm (467). Tie Straps (400) to Tether Mast (110).

The internal partitioning and tough back-panel allows great height/width with stability and ballistic resistance.

The internal partitioning improves the ballistic resistance performance by impeding the 'rate of cavity growth' imparted by the projectile. Embodiments of the invention have shown proven stability of 8 foot wall and the proof of resistance to ballistic penetration. In one embodiment the aspect-ratio of the wall is about 4:1 which is at a higher range of suitable aspect-ratio. This relatively higher aspect-ratio provides for more efficient use of fill. The walls may be tapered or the taper may be increased as required, for example an increase to 1000 mm from 600 nm at base if greater stability is required, Bell bottom Style (430) for Stability. A double-wall, of 4:1 aspect ratio, may be used for greater, stopping power, for example to stop a rocket propelled grenade (RPG).

The internal partitioning or bracing acting under tension to maintain hydrostatic pressure of fill. The internal partitioning must be semi-rigid (vs fabric) to allow the empty curtainwall to be self-supporting and keep shape during fill. The semi-rigid partitioning is key to ballistic performance since the partitions restrict cavity growth. The heavier DASL fabric skin is also key to maintaining hydrostatic forces of fill. An aramid back panel, Back Panel (410) to be 31 oz Kevlar™ material, of the frag wall (370) improves ballistic resistance.

The internal partitions may be set parallel to the expected direction of projectile (i.e. orthogonal to front surface or front panel of the frag wall), Blast Wave (450), or angled to meet particular specifications. Angled partitions help provide an inherently stronger self-supporting member. However, the end-frames for each wall segment may be used to augment stability, keep the shape (especially on deployment for the 90 degree partitions). Ninety (90) degree angled partitions are desirable for improved folding, ease of fabrication and uniformity of ballistic resistance. The metal end-frames are more important to 90 degree partitioning. The metal end-frames are key to support hopper fill process. Outriggers of base of metal end-frames can be extended as required for additional stability for uneven terrain. Cable or cables running through sleeve at or near top of the wall may be used to ensure entire wall tied together to provide further resistance to overturning.

We refer to it as a "curtain wall" when it is empty, capable of defending against industrial debris in an explosion. We refer to it as a frag wall when it is in geotextile form or with fill and defending against armed fire, ballistics, mortar and artillery fragments.

The frag wall may be stand-alone. As shown, the cross-section shape being broader at the base than the top provides improved stability. A series of frag walls could be assembled to form a bastion.

The frag wall includes a series of cells, created by fusing PVC coated materials into a corrugated form or geotextile wall section. The wall sections require ancillary support such as from our tether mast or the support of other building walls or support member. There are no wires or hard framed elements to our system.

The frag wall may be conveniently emptied for redeployment or reuse, for example by toppling it over and then lifting a portion of the wall to allow the fill to pour out of the bottom, Double flap (420) at bottom to empty, or the top, fill flap (390), or both.

Figures 31, 31A:
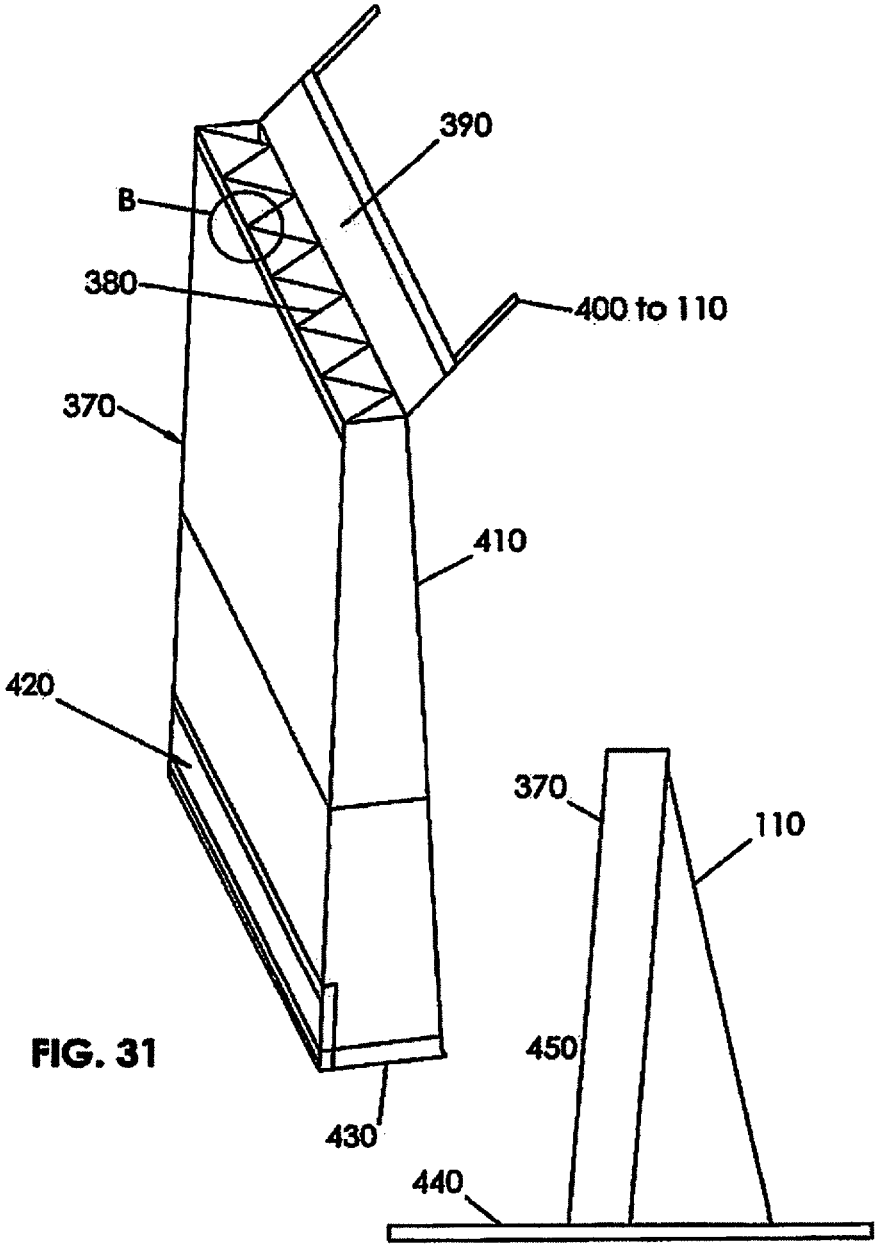
FIG. 31 is a perspective view of a frag wall of the present invention.
FIG. 31A is a side view of a frag wall of the present invention.
Figure 32:
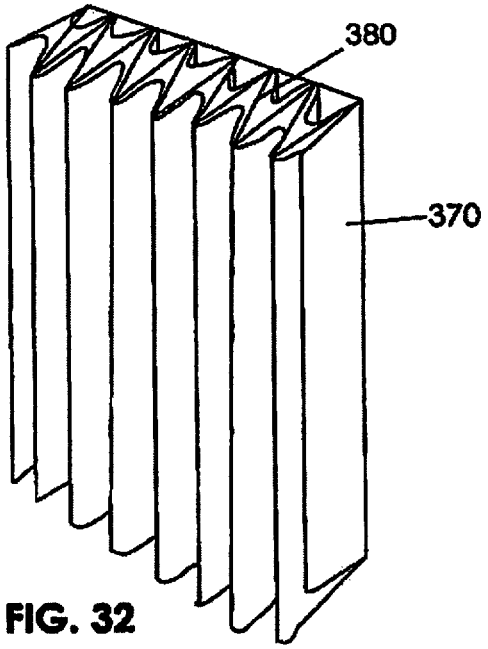
FIG. 32 is a perspective view of the frag wall of FIG. 31 (shown in a shipping or storage configuration)

Referring to FIG. 31A, the flexible tethermast may be connected to or integral with a base to support the frag curtain (see also the tethermast/base configuration of FIG. 30, but the 'L-shaped' base/tethermast is in the reverse orientation with the base extending away from the blast direction). In FIG. 30 the frag wall sits proximate the base/tethermast (110), and in FIG. 31A the frag curtain or frag wall sits on the base (440). The weight of the filled frag wall (370) or frag curtain provides stability to the base (440) and tethermast (110) so the system is free-standing or self-supporting.

The frag wall fill may be a wide variety of materials including sand, cement, water, soil, clay, and other fills known to one skilled in the art or mixtures or combinations thereof. The frag wall includes an upper fill flap to allow closure of the frag wall after the frag wall fill is added. The frag wall includes a lower flap (420) to allow the drainage or removal of the frag wall fill for demolition of the frag wall for transport to another location. The back side (being the side opposite the side expected to experience the blast or pressure wave (450)) may utilize fiber reinforced materials, such as aramid fibers or para-aramid fibers, such as Kevlar™.

Figure 34:
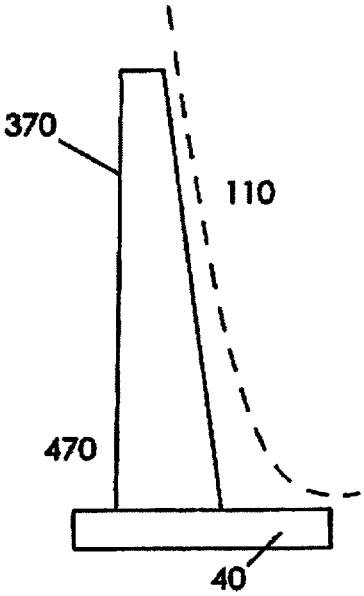
FIG. 34 is a side view of a frag wall of the present invention (self-supporting)

Referring to FIG. 34 (and FIG. 30), the frag wall (370) may rest upon the support surface (40) and be connected to the tethermast (110) (or tethermasts). External Face (470).

Figure 35:
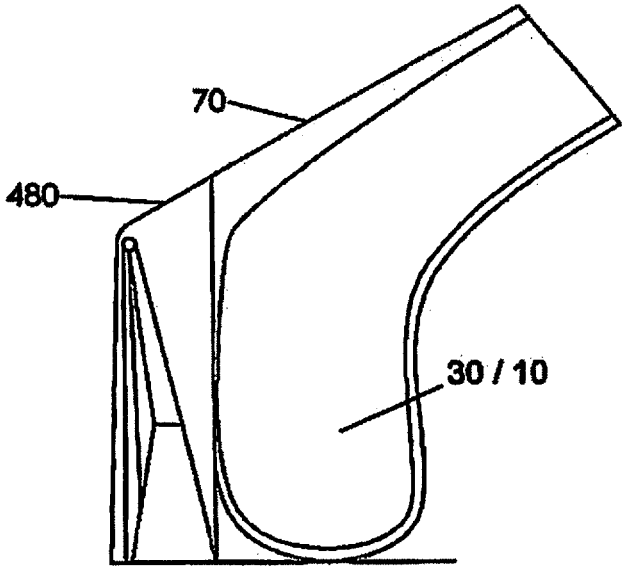
FIG. 35 is a side view of a tether system of the present invention (at rest)
Figure 36:
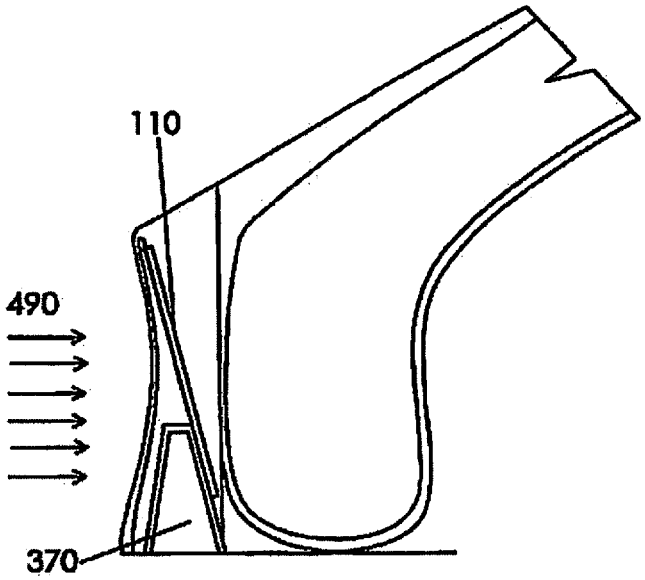
FIG. 36 is a side view of a tether system of the present invention (in deformation)

Referring to FIGS. 35-36, an extension flap (480) may be attached to the external fly and extend over the frag wall (or frag curtain). Extension flap (480) welded on fly passes over curtain system as rain/snow/leaf shed; plastic tube sheath over curtain cable; many options for lay-up of multiple curtain layers to be optimized by modelling or testing. Referring to FIG. 36, a pressure wave, pressure (490), such as a blast wave, sets the tethermast into pre-tension providing increased stiffness to the main load on the structure. Initial blast load to external curtain sets tethermast into pre-tension reinforcing stiffness to main load on shelter.

Figure 37:
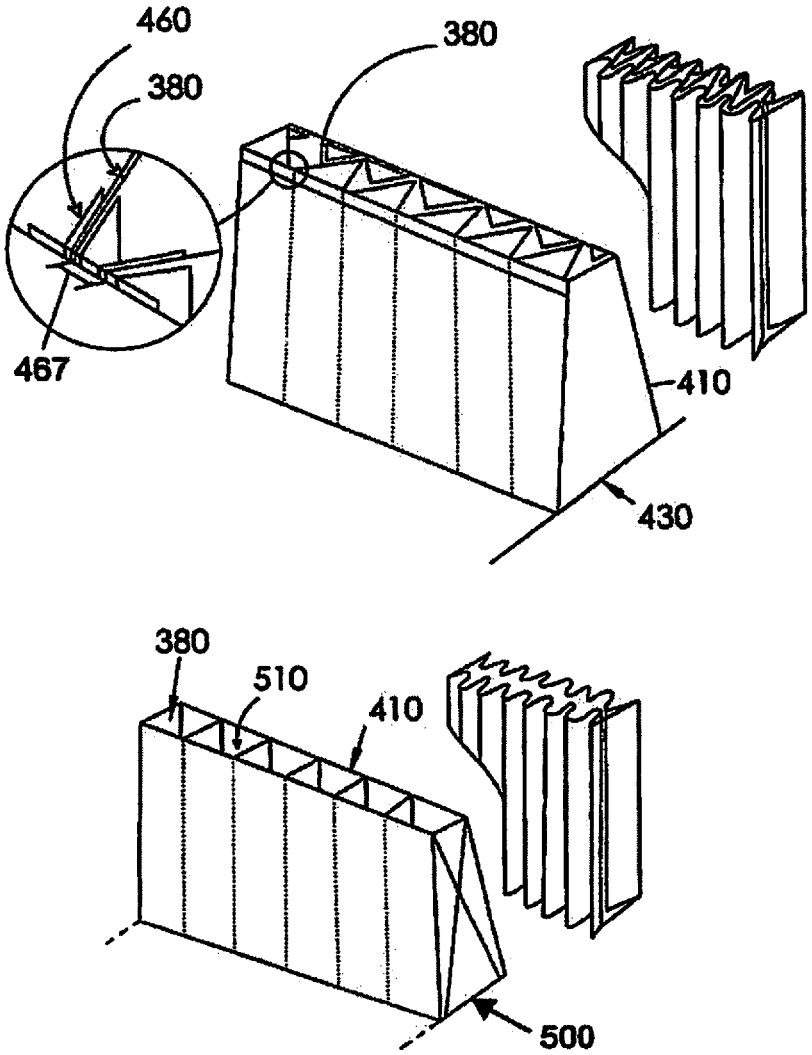
FIG. 37 is Sketch of a curtainwall segment showing two partitioning options. The walls are packed concertina-style for storage and shipping and filled on-site with local geological materials.

Referring to FIG. 37, the high yet stabile aspect-ratio of the curtainwall improves its efficiency in providing maximum ballistic protection without excessive fill of current block bastion-type walls. The stability and ballistic performance of the curtainwall relates to its unique design involving use of semi-rigid internal partitioning as shown in FIG. 37. As used herein, 'semi-rigid' refers to a lightweight yet flexible board-type material. 2 mm fiberglass sheet might be considered for illustration purposes, although many options may suffice including composite vinyl boards (DASLboard). Optional cavity fills (510).

Each partition should be capable of supporting a distributed vertical load along each vertical edge of about 2-3 kgs, being the approximate deadweight of the fabric material of the front and back of the local curtainwall segment to which it is attached. The thickness, height, and vertical taper profile of the wall are adjustable dependent on the threat to be countered. The partitions may be diagonal or 'straight-across' with respect to the line of the wall. Simple metal or composite end-frames (500) for each segment as shown in FIG. 37 provide transverse shear and 'toppling' resistance during deployment prior to filling. Single or double-tapered walls as required.

Figure 38:
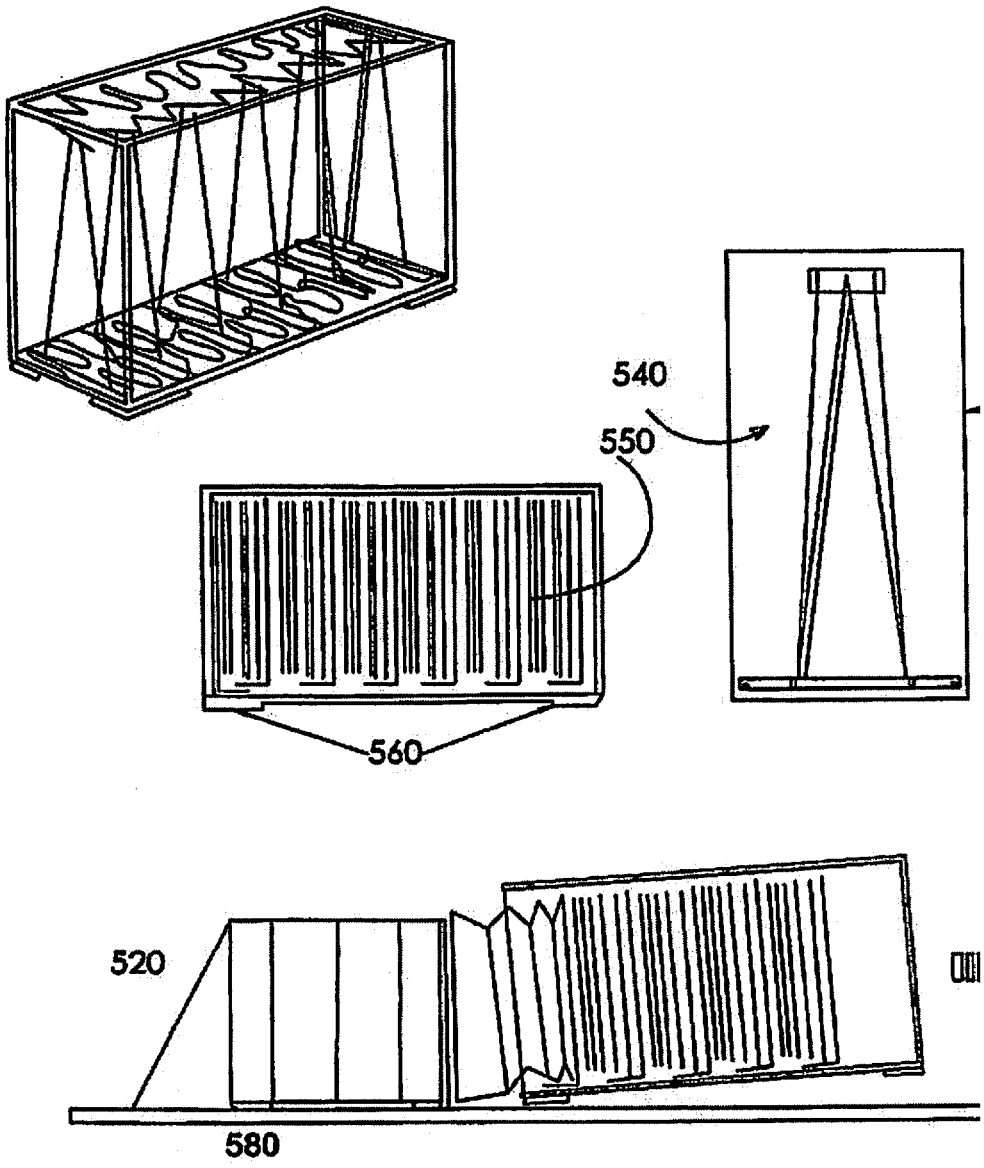
FIG. 38 is a one embodiment of a method for packing and deployment of multiple linked curtainwall segments requiring minimal mechanized support.

Referring to FIG. 38, akin to corrugated cardboard, one role of the partitioning is to act as internal bracing to provide both vertical and transverse stiffness to the fabric curtainwall. Diagonal partitioning allows the wall to be fully self-supporting prior to fill and to maintain a 'tight' shape without slumping during and after filling with geologic materials including soils, sand, or crushed rock. Another option exists to allow insertion of a bladder within each partitions for water fill of the 'cells' or cavities defined by the partitioning. When a line of curtainwall segments is deployed they may be tied together by means of the intermediary frame segments as well as a longitudinal cable along the top edge of the wall. By this means the entire wall will resist any overturning action imparted to any individual segment, for example by impact of a projectile upon the individual segment. Shipping/Deployment Crate (530) (~6 wall segments) 8.5'h×4.5' w×10' l. Space (540) available for tethermast components. Concertina sections (550) prelinked at factory. Box skid or skis (560). Initial stabilizing stays (520). Ground pegs (580) stake wall position while deploying. Shipping crate dragged by bobcat.

Figure 39:
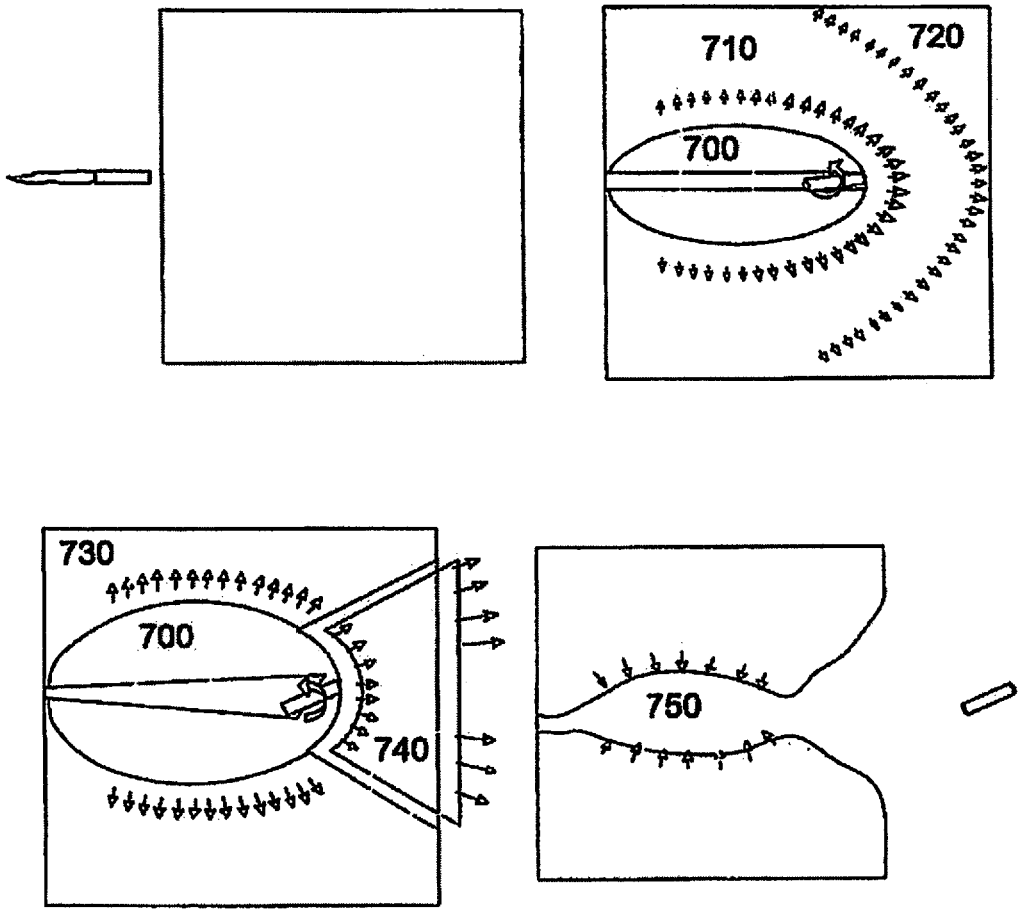
(PRIOR ART) FIG. 39
FIG. 39 is a top view depiction of a projectile penetrating a (prior art) wall of granular material without internal partitioning.
Figure 40:
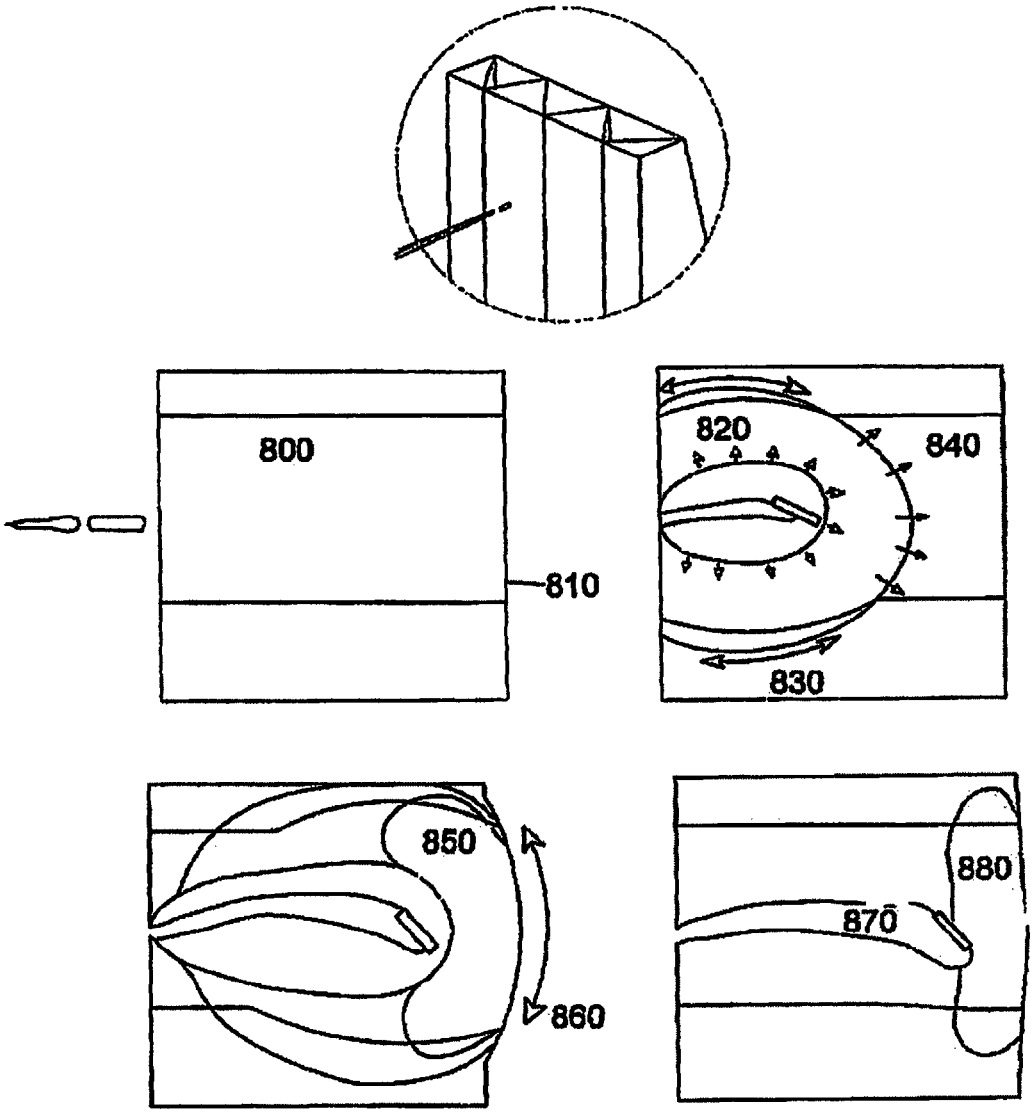
FIG. 40 is a top view depiction of a projectile impact upon a partitioned curtainwall with reinforced fabric back-panel.

Referring to FIGS. 39 and 40, the second important role of the internal partitioning concerns the frag wall resistance to ballistic penetration.

FIG. 39 provides a depiction of a wall of granular fill without internal partitioning and without a reinforced back panel. Ballistic penetration of a fluid or granular substance (that is, having low bulk shear resistance or strength) such as geological material relates directly to the 'rate of cavity growth' caused by the passage of the projectile. Generally, the kinetic energy imparted by the impact of the projectile causes the grains (or fluid for fluid-filled cavities) to be flung outwards in a manner to cause a void around the projectile. The ease by which this cavity is formed and expanded relates directly to the depth of penetration. Expanding temporary cavity (700). Compacted and accelerated zone (710). Compression front (720). Compacted and expanding material (730). Weak backing allows material and projectile to 'blow out' backside (740). Cavity collapse (750).

FIG. 40 provides a depiction of a wall of the present invention, having internal partitions and a reinforced back panel. The front or 'threat side' fabric panel of the curtainwall requires only sufficient strength to contain the hydrostatic pressure of the fill and stresses from rough filling; this panel is expected to be locally penetrated by high energy projectiles such as bullets or bomb fragments. However, the membrane action of the remaining fabric of the front panel and especially the internal partitioning of the curtainwall greatly impedes the subsequent rate of internal cavity growth. The fill material accelerated by the projectile compression wave is restrained by the bending and membrane resistance of the partition material. Membrane partition (800). High strength membrane bracing (810). Expanding temporary cavity (820). Membrane action retards/distorts cavity growth, increases compaction (830). Compression zone (840). High compaction zone (850). Distributed compression taken by strong-back membrane (860). Cavity collapse (870). Residual compaction (880).

The back panel of the curtainwall is specially reinforced such as with aramid fiber while retaining flexibility to act primarily in membrane action. Kevlar® or fiberglass are also suitable for fabrication or reinforcement of the back panel. The compressed and accelerated material ahead of the projectile is retained by the tough back membrane. The action of the back membrane greatly reduces the cavity growth and eliminates the back 'blow out' of the fill material. Therefore, the compression imparted in the material by the projectile is ultimately used to retard its penetration. The flexing membrane action combined with toughness of the back panel is required for this performance.

In the event the back panel were to fail, the ultimate failure would be rupture from over-pressurization from the distributed load of the fill material rather than localized shear-type puncture by the projectile itself.

Figure 41:
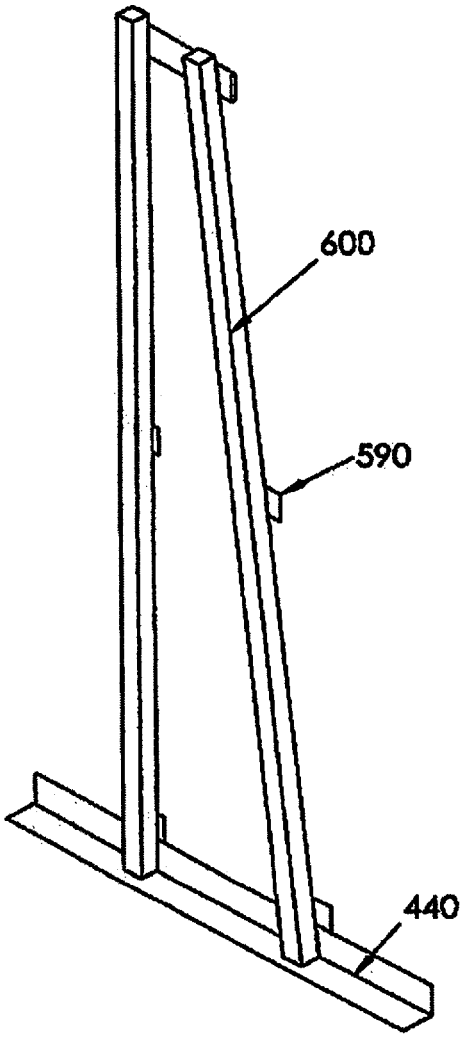
FIG. 41 is an isometric view of a frag wall support of the present invention.
Figure 42:
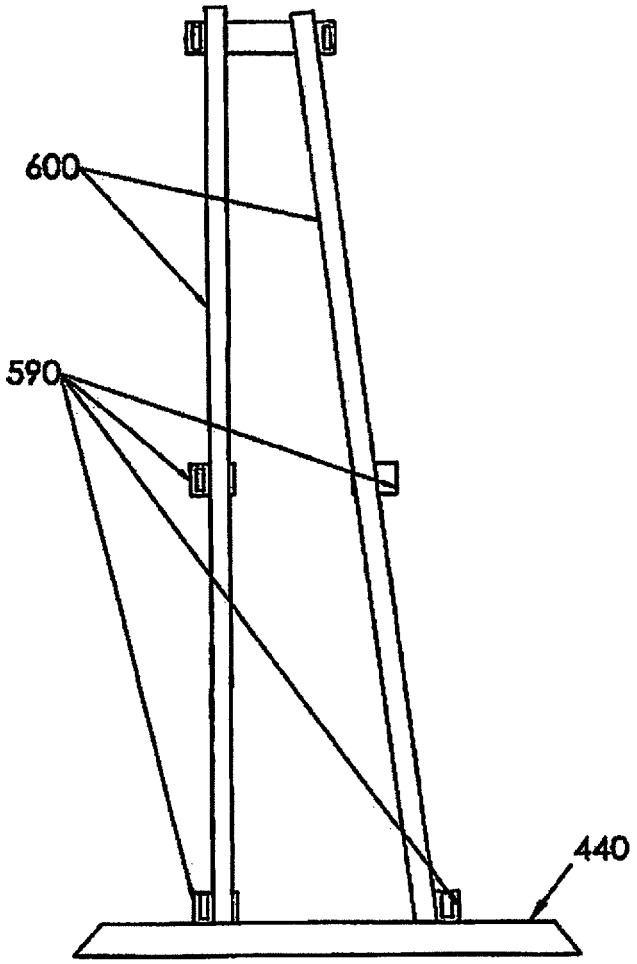
FIG. 42 is an end view of the frag wall of FIG. 41.

Referring to FIGS. 41 and 42, a frag wall support (600) includes a stabilizing member and a support frame. Slot (590).

Figure 43:
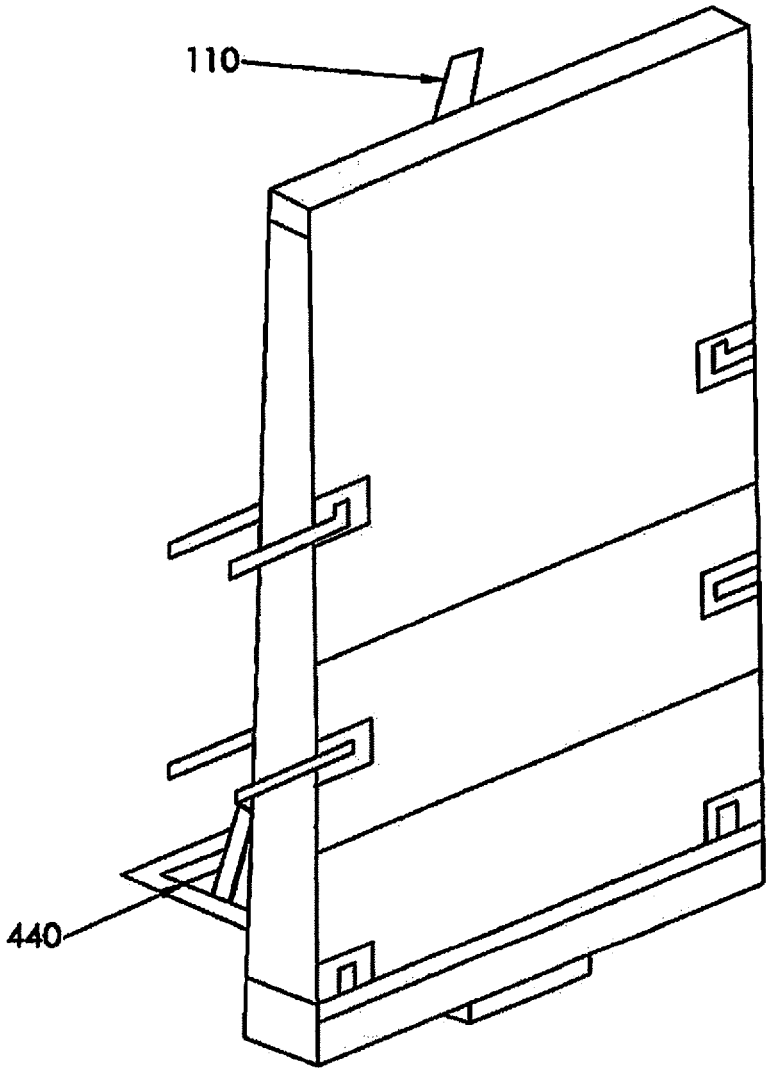
FIG. 43 is an isometric view of an embodiment of a frag wall of the present invention.
Figure 44:
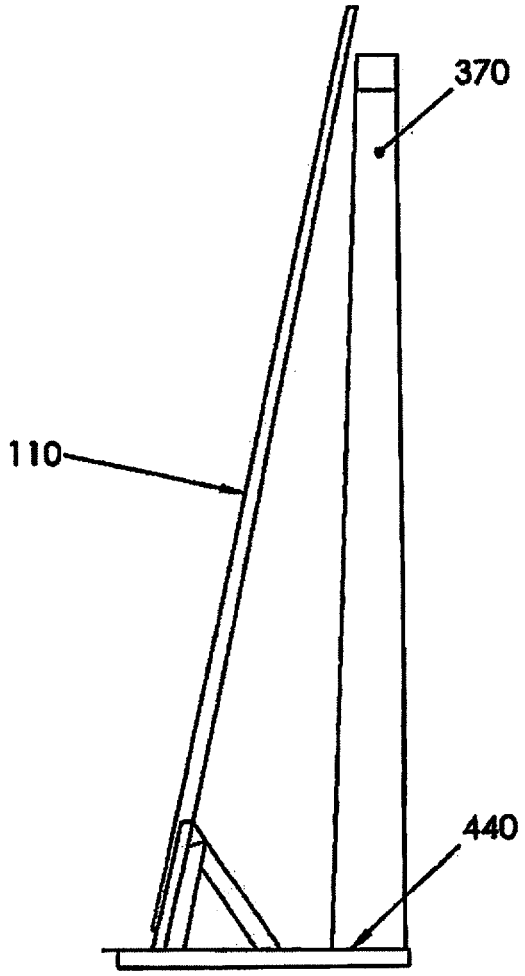
FIG. 44 is a side view of the frag wall of FIG. 43.

Referring to FIGS. 43 and 44, a frag wall support (600) may include a base (440) upon which the frag wall (370) sits, a flexible member extending upward from the base, the frag wall supported or restrained at least partially by a connection between the frag wall and an upper portion of the flexible member. The flexible member may be, for example, a tethermast (110) of the present invention.

Figure 45:
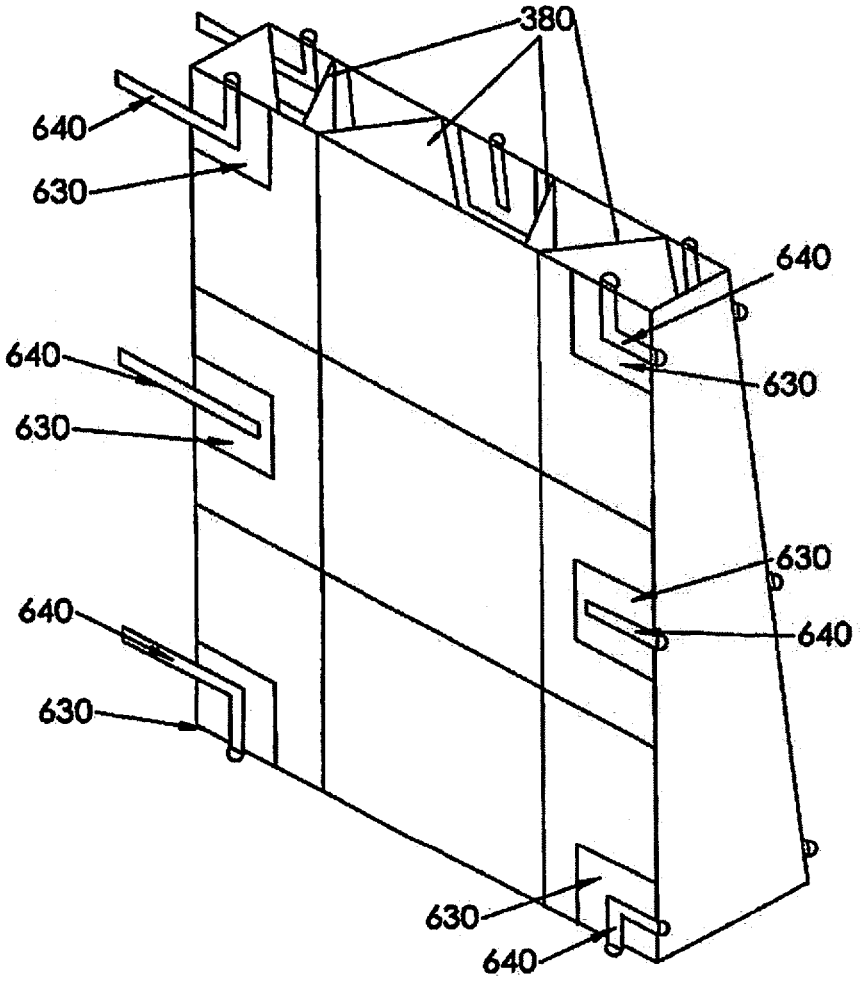
FIG. 45 is a front isometric view of an embodiment of a frag wall of the present invention.
Figure 46:
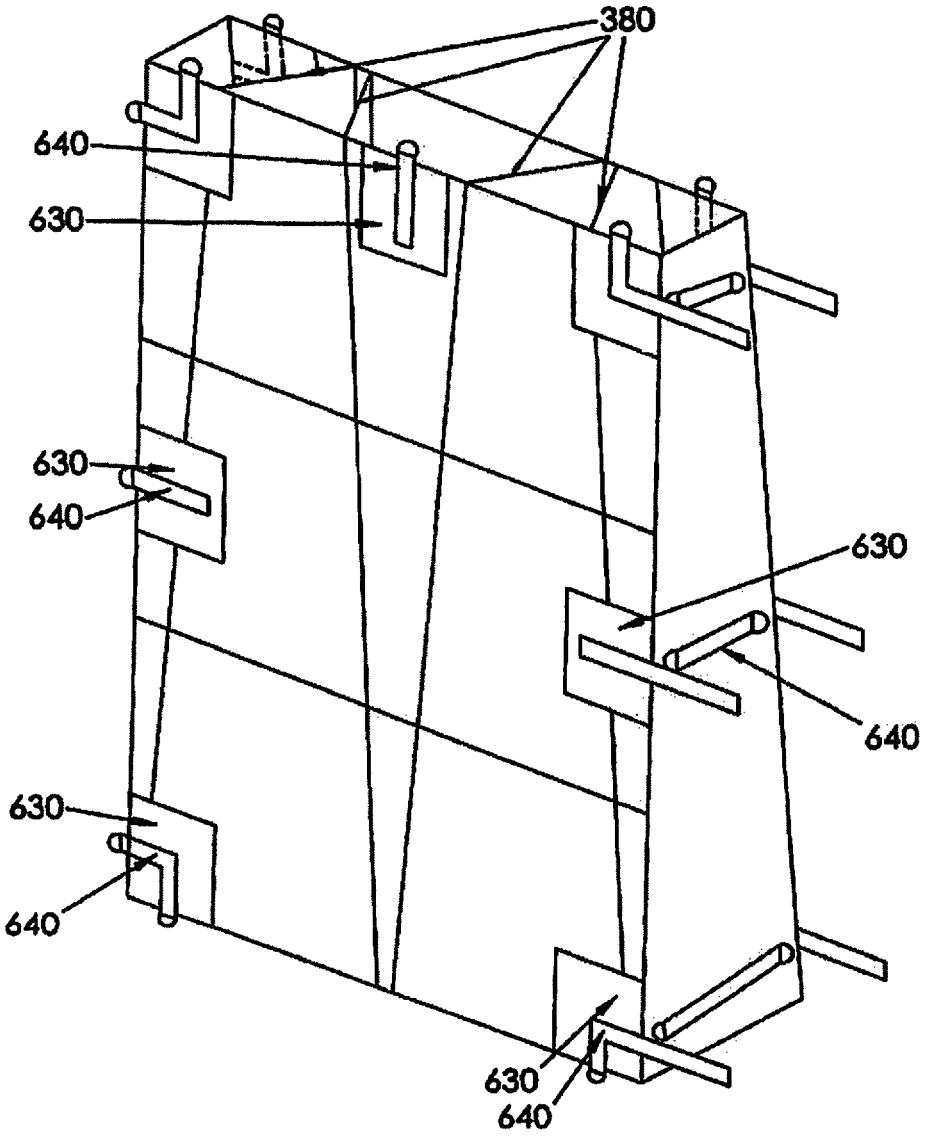
FIG. 46 is a rear isometric view of the frag wall of FIG. 45.

Referring to FIGS. 45 and 46, a section of a frag wall is shown. The partitions or end panels or both may be constructed of or reinforced with, for example, corrugated plastic, such as Core Plast™. A webbing pad (630) may be formed into portions of the front panel or rear panel or both to receive a webbing material. The webbing (640) may be used to connect the section of frag wall to a support.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

The invention claimed is:

1. An air beam system for an air beam structure, comprising:

a. at least two flexible tethermasts (110) attached respectively to opposite ends of at least one airbeam (30) and supporting said at least one air beam (30);

b. at least one air beam sling (190) that extends around a peripheral portion of said at least one air beam (30) and extends along a length of the at least one air beam (30), the at least one air beam sling (190) coupling the at least two flexible tethermasts (110) and the at least one air beam (30).

2. The air beam system as per claim 1, wherein the at least one air beam comprises a pair of two parallel air beams.

3. The air beam system of claim 2, further comprising an external fly (70) that extends across the at least two mutually parallel air beams (30).

4. The air beam system of claim 2, wherein the at least one air beam sling comprises a pair of air beam slings which each extends, respectively, around a portion and along a length of each of the pair of two mutually parallel air beams.

5. The air beam system of claim 1, wherein the at least one air beam sling further comprises at least one reinforcing member.

6. The air beam system of claim 1, further comprising a cable (90) that extends along and is attached to said at least one air beam (30), wherein the cable (90) is further attached to the flexible tethermasts (110) for supporting said at least one air beam.

7. The air beam system of claim 1, further comprising a support member (120) that is attached to each flexible tethermast (110) and extends along a length that is substantially normal a longitudinal axis of said at least one air beam.

8. The air beam system as claimed in claim 1, further having a support surface (40), wherein at least one of said flexible tethermasts is secured to such support surface (40).

9. The air beam system as claimed in claim 1, wherein each flexible tethermast is secured to a support surface (40), said support surface supporting each of said at least two flexible tethermasts (110).

10. The air beam system as claimed in claim 6, having at least two cables (90), and a pair of mutually parallel air beams, wherein each cable (90) extends along and is attached to a respective air beam of said two mutually parallel air beams (30), the at least two cables (90) being also attached at their opposite ends to a respective tethermast of said at least two flexible tethermasts (110) for supporting said respective air beams.

* * * * *